United States Patent [19]

Strongwater

[11] 4,100,623

[45] Jul. 18, 1978

[54] GENUINE LEATHER FABRIC AND METHOD FOR MAKING SAME

[76] Inventor: Murray Strongwater, 822 Moore St., Woodmere, N.Y. 11598

[21] Appl. No.: 767,508

[22] Filed: Feb. 10, 1977

[51] Int. Cl.[2] ..... A41D 19/02

[52] U.S. Cl. ..... 2/158; 2/163; 2/169

[58] Field of Search ..... 69/21; 36/45; 2/167, 2/163, 169, 158; 428/473, 316, 540; 150/28 R, 30

[56] References Cited

U.S. PATENT DOCUMENTS

| | | | |
|---|---|---|---|
| 1,400,899 | 12/1921 | Nakayama et al. | 428/473 X |
| 1,402,085 | 1/1922 | Nakayama et al. | 428/473 X |
| 1,417,323 | 5/1922 | Hollenbeck | 2/158 |
| 1,538,263 | 5/1925 | Ackerman | 2/169 |
| 1,736,928 | 11/1929 | Lowe | 2/169 X |
| 2,001,962 | 5/1935 | Kantron | 69/21 X |
| 2,132,399 | 10/1938 | Cooper | 2/169 X |
| 2,144,980 | 1/1939 | Johanson | 2/169 X |
| 2,316,351 | 4/1943 | Miller | 69/21 X |
| 2,358,404 | 9/1944 | Lennon | 69/21 X |
| 2,385,884 | 10/1945 | Schneider | 2/65 X |
| 2,728,082 | 12/1955 | Slimovitz | 2/167 |
| 3,278,944 | 10/1966 | Gavers | 2/159 |
| 3,913,509 | 10/1975 | Ramon | 428/473 X |

*Primary Examiner*—Werner H. Schroeder
*Attorney, Agent, or Firm*—Henry R. Lerner

[57] ABSTRACT

Genuine leather fabric in the piece comprising a plurality of geometrical sections cut from genuine leather left over scrap, said sections being of selectively predetermined configurations and being secured to each other in end-to-end and side-by-side relation to form a continuous piece which defines said genuine leather fabric in the piece having ornamental characteristics imparted thereto by said secured together sections of predetermined geometrical configuration. The resulting fabric can then be cut in accordance with conventional patterns to form the panels which are assembled and finished into completed articles, such as gloves.

3 Claims, 14 Drawing Figures

GENUINE LEATHER FABRIC AND METHOD FOR MAKING SAME

BACKGROUND OF THE INVENTION

The present invention relates to a novel method for making genuine leather piece goods which can then be utilized for the manufactured of a variety of articles, especially gloves.

Genuine leather has so risen in cost and in scarcity as to severely limit the realistic availability of genuine leather as a material for manufacturing articles of wearing apparel and particularly gloves. For example, gloves made of genuine leather which had been available in the past at a relatively reasonable cost and thus within the means of most consumers, have now become luxury items accessible only to the few.

Furthermore, genuine leather is usually not readily susceptible to creative design within the material itself. Thus, most articles made of leather are usually solid in appearance and void of some measure of distinctiveness, therefore reducing the flexibility with which leather can be used in different and exciting ways in connection with the embodiment thereof within articles to be worn by consumers. As a result of this lack of flexibility, though genuine leather articles are rather expensive and often prohibitive, they all look fairly bland in design, with the result that most leather gloves look like each other. Plainly speaking, the leather on these gloves is unicolor and solid throughout the extent of the article.

SUMMARY OF THE INVENTION

It is therefore an object of this invention to provide a new method of making genuine leather piece goods which is far less costly than conventional genuine leather and which is simultaneously more distinctive in appearance, having an inherent ornamental non-bland appearance which is imparted to articles made of such new leather piece goods.

The invention is based in part on the realization that during the manufacture of numerous articles made of genuine leather, there is a great deal of remaining unused leather which is generally referred to as scrap. Such scrap is what is left over from the leather piece goods after there has been cut therefrom the various panels, pursuant to patterns dictated by the design of the particular garment being cut. Thus, for example, the cutting of leather pursuant to patterns relating to a leather jacket article leaves substantial amounts of leather scrap which is generally thought of as being total waste, used in large measure for patching up.

In accordance with the invention, the scraps of left over genuine leather from the conventional cutting operation are utilized to form genuine leather piece goods as contemplated herein. More specifically, these scraps are cut into geometric configurations, such as squares, rectangles, or any other type of regular or irregular polygon. These geometric figures are then stitched together to form rows of such figures and a plurality of these rows are stitched in side-by-side relation to define the novel genuine leather piece goods in accordance with the invention.

In stitching together geometrical figures, there can selectively be used such figures of different shades and even of different colors to provide finished piece goods which are highly distinctive and ornamental creating a checkerboard effect heretofore unattainable in genuine leather piece goods. It is also contemplated that different geometrical figures could be combined within one given length of piece goods, for example, rows made of square geometrical figures could be stitched in staggered relation with rows of geometric figures having a rectangular configuration. It will be evident that the variety of combinations is virtually unlimited with the common denominator being the use of individual geometric figures of genuine leather stitched together in some predetermined fashion to create novel genuine leather piece goods heretofore unknown, which goods are particularly suitable for making fashion or work gloves and mittens for conventional, sport as well as industrial use.

DESCRIPTION OF THE PREFERRED EMBODIMENTS

Figure 1:
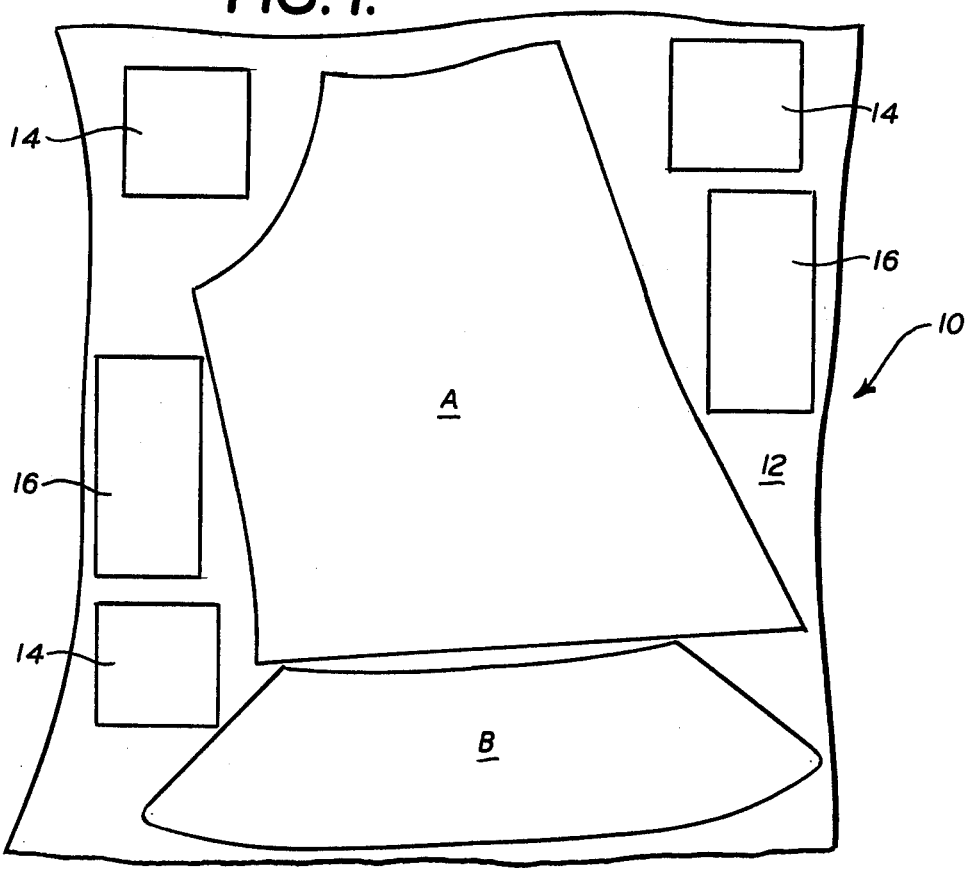
FIG. 1 represents a conventional piece of genuine leather showing the manner in which geometrical figures are cut from left over scrap for forming the novel genuine leather piece goods in accordance with the invention.
Figure 2:
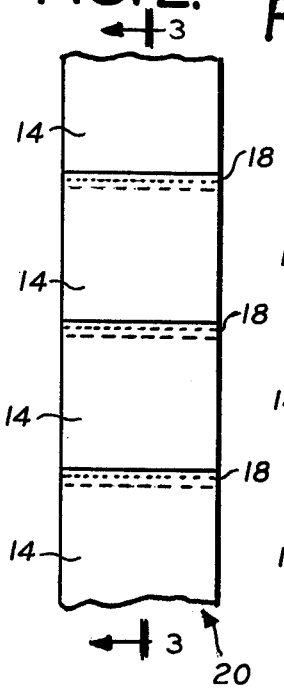
FIG. 2 illustrates the manner in which a plurality of square leather sections, cut from scrap, are assembled to form rows.
Figure 3:
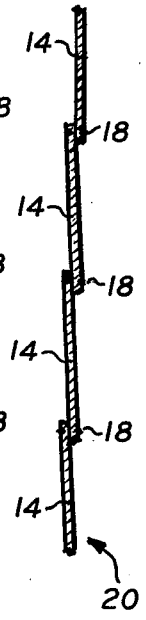
FIG. 3 is a section taken along lines 3—3 of FIG. 2.

Referring now to FIG. 1, there is shown a length of 10 of genuine leather piece goods and adapted to have cut therefrom panels A and B, which are required in connection with the manufacture of a genuine leather garment. Upon severance of said panels A and B from piece goods 10, there will remain left over genuine leather scrap material 12 for which there has heretofore been no significant use. In accordance with the invention, there is cut from left over scrap 12 as many geometric figures as can be secured from said left over scrap, as for example, squares 14, rectangle 16, and other possible geometric figures which can be accommodated within left over scrap piece 12. The individual square scrap sections 14 are then stitched together, as shown in FIGS. 2 and 3, along lines of stitching 18 to define longitudinal strips 20 made up of a plurality of genuine leather squares.

Figure 4:
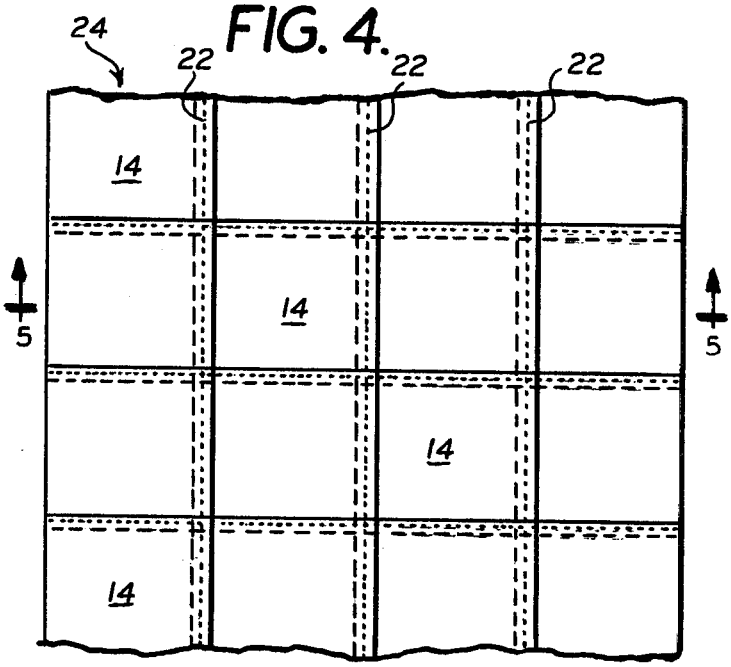
FIG. 4 illustrates the manner in which the rows of FIG. 2 are assembled to form the leather piece goods in accordance with the invention.
Figure 5:
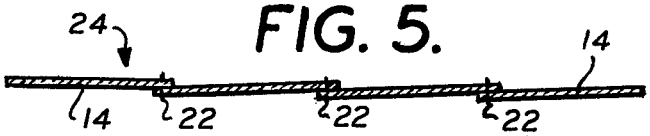
FIG. 5 is a section taken along lines 5—5 of FIG. 4.

Thereafter, a plurality of strips 20 are stitched together in side-by-side relation along lines of stitching 22 to define genuine leather piece goods 24 as best shown in FIGS. 4 and 5 pursuant to the invention.

Once genuine leather piece goods 24 has been formed in the aforedescribed manner, it is essentially used in the same manner as conventional solid leather in the piece for manufacturing articles therefrom. More specifically, newly formed genuine leather in the piece 24 is cut in accordance with predetermined patterns to provide the sections necessary to define a completed article such as a glove.

Figure 6:
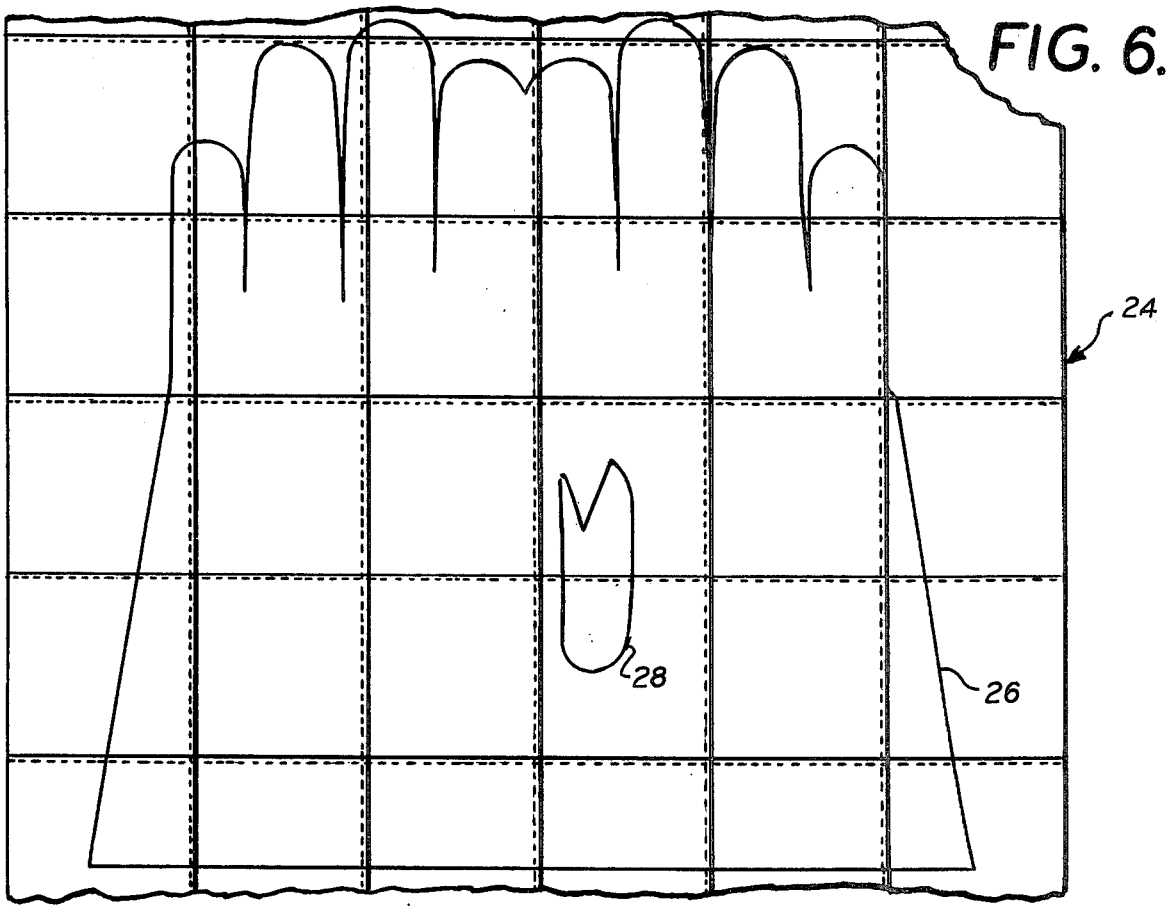
FIG. 6 illustrates the manner in which a glove blank is obtained from the novel genuine leather piece goods in accordance with the invention.
Figure 7:
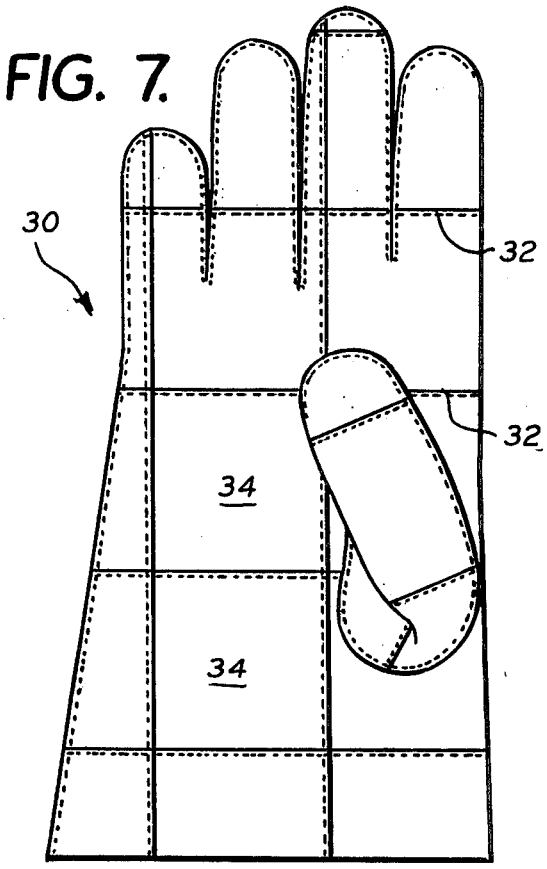
FIG. 7 illustrates a finished glove obtained with the form as cut in FIG. 6.

FIG. 6 illustrates a section of genuine leather in the piece 24 as formed by the above described novel method upon which there is placed a pattern having contour outline 26 which defines the main panel required to form a conventional glove. When leather piece 24 is cut along pattern outline 26, the resulting cut section is stitched in the conventional manner after which a thumb section is further stitched at the contour outline of cutout 28 resulting in a finished glove 30 as shown in FIG. 7. It will be noted that finished glove 30 is highly distinctive and attractive in appearance due particularly to the incorporation therein of numerous lines of stitching 32 combining regularity and irregularity to impart to the glove a highly exciting appearance heretofore not available in gloves formed of conventional genuine leather in the piece. At the same time it will be apparent that the glove in all other respects has the same characteristics of gloves made of conventional genuine leather in the piece in terms of the ability of the glove to provide warmth and comfort and to be durable. It will of course be apparent that glove 30, with all the advantages it possesses as described above, can be manufactured at a far lower cost than gloves made of conventional leather in the piece.

It is also evident from the above, without requiring illustration, that the individual square sections 34 forming part of glove 30 need not be of the same shade or even of the same color whereby greater flexibility is available in forming gloves which are highly attractive and exciting and constitute a significant departure from presently available leather gloves.

Figure 8:
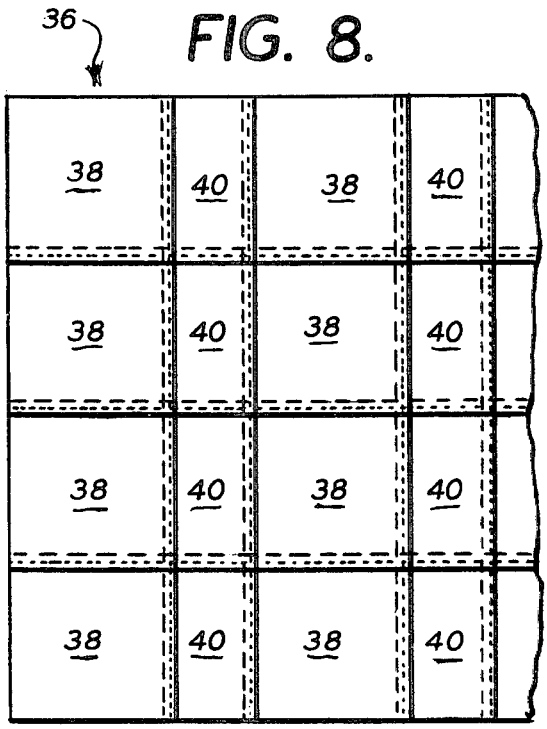
FIGS. 8, 9, 10 and 11 illustrates other embodiments of genuine leather piece goods made in accordance with the invention.

FIG. 8 illustrates another embodiment 36 of leather in the piece made in accordance with the invention wherein there are provided rows of square sections 38 separated by rows of rectangular sections 40. Such arrangement enables the utilization of leather scrap normally discarded while the same time participating in the creation of a newly formed genuine leather in the piece having a highly distinctive and ornamental appearance for incorporation in gloves or other articles of wearing apparel to impart thereto similar non-conventional and exciting characteristics.

Figure 9:
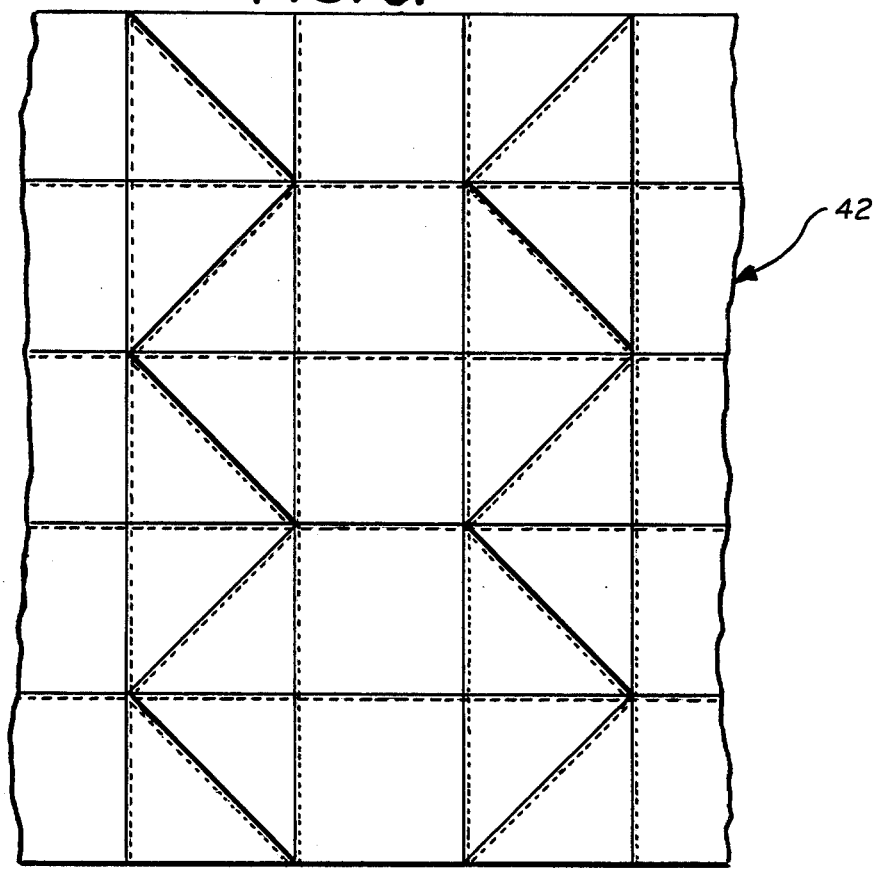
Figure 10:
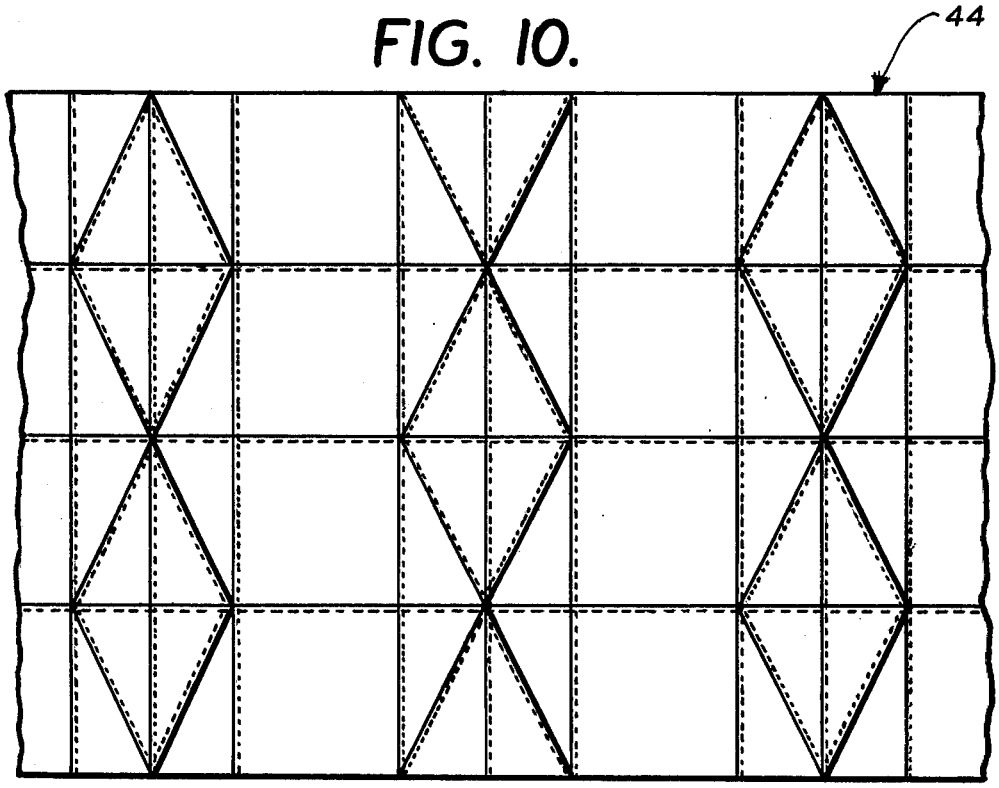
Figure 11:
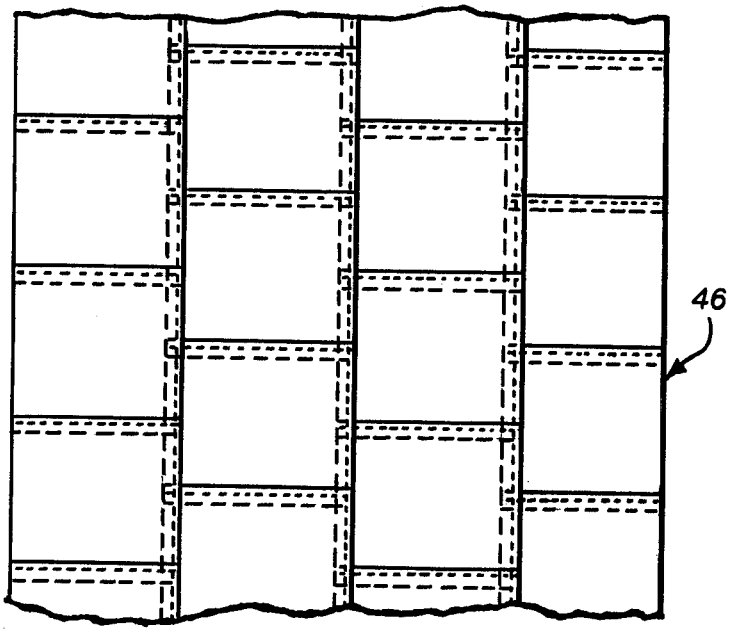

It will be understood that there is in effect a limitless combination of geometric sections, shades and colors which can be assembled in any desired arrangement as may be conceived, further illustrations of variations being shown at 42 in FIG. 9, at 44 in FIG. 10, and at 46 in FIG. 11.

Figure 12:
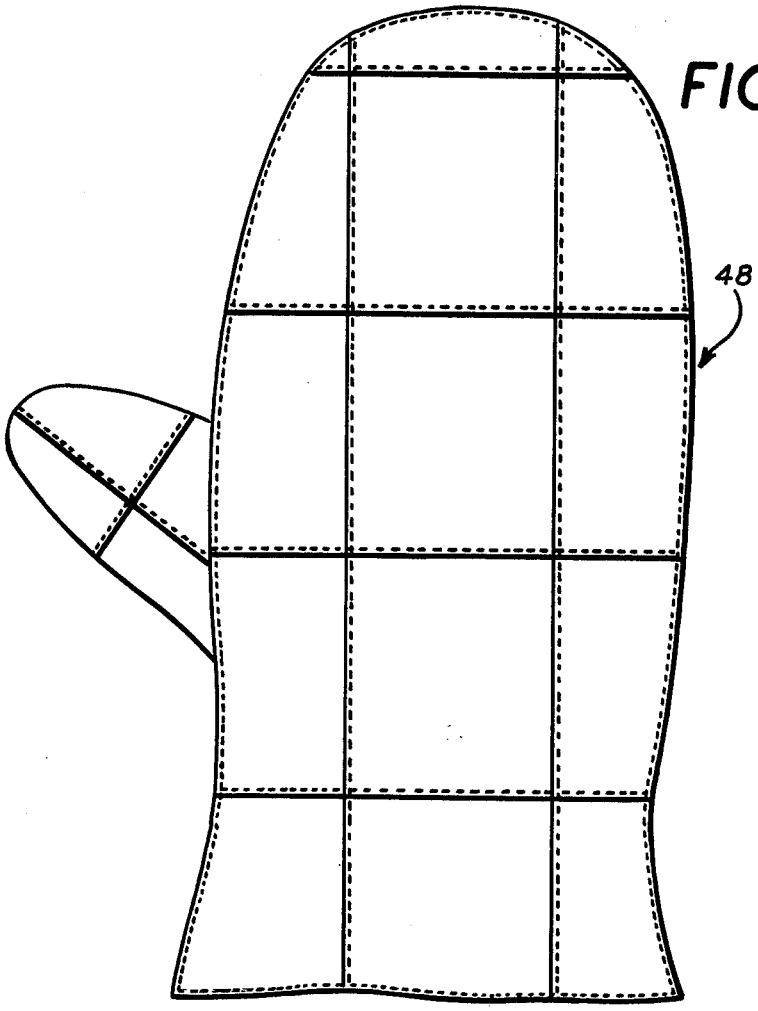
FIG. 12 illustrates a finished mitten in accordance with the invention.

It will be understood that the gloves as aforedescribed embodying the invention can be used as dress fashion gloves, as work gloves for industrial purposes, and as sport gloves. In this connection, it is also understood that instead of gloves, the novel fabric in accordance with the invention could easily be made into mittens, an example of which is shown at 48 in FIG. 12.

Figure 13A:
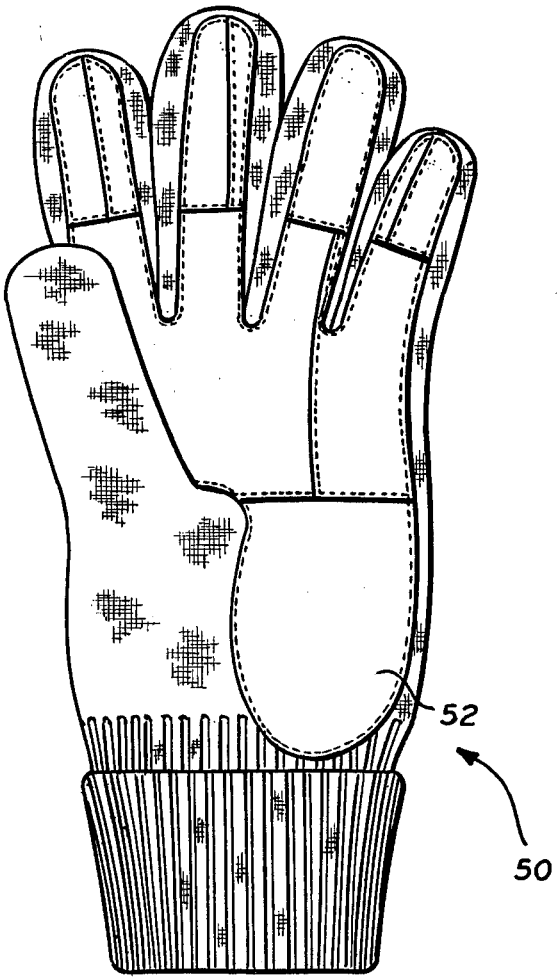
FIGS. 13*a* and 13*b* illustrate two sides of another embodiment of a glove in accordance with the invention.
Figure 13B:
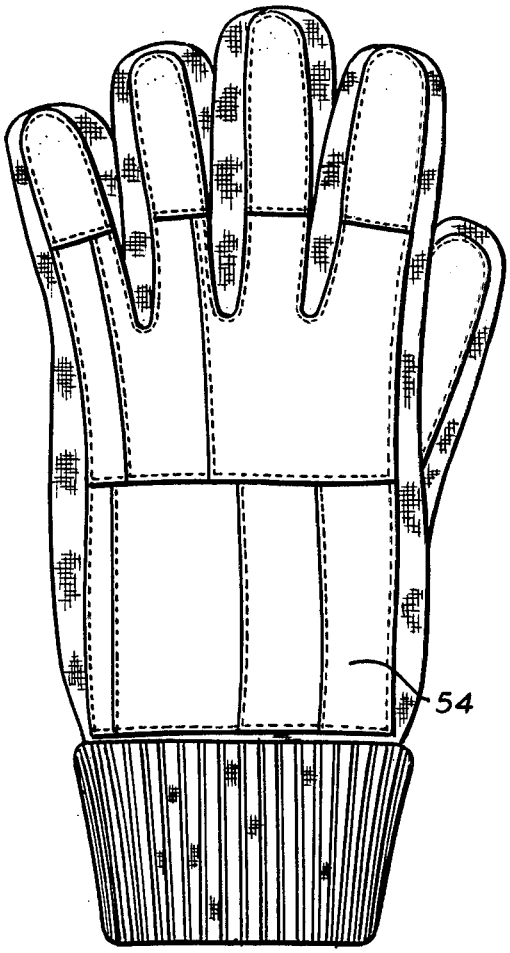

Referring now to FIGS. 13a and 13b, there is shown herein another embodiment of the invention. In accordance with this embodiment, the newly formed genuine leather piece goods is cut into a panel to be used as an applique on conventional fabric gloves. More specifically, in FIG. 13a, there is shown the palm side of a leather glove 50, which is made of conventional fabric, such as knit goods, to which there has been stitched a panel 52 made of the novel genuine leather piece goods in accordance with the invention. Panel 52, therefore, defines an applique for the knit glove which has imparted thereto the novel characteristics of the genuine leather piece goods. If desired, the opposite side of the same glove shown in FIG. 13*b* can similarly be provided with an applique panel 54. As referred to in this specification, the term "leather fabric" is defined as piece goods in the form of sheets made up of genuine leather sections stitched together to define such sheets, such as shown illustratively in FIGS. 4 and 8 through 11.

While there is herein shown and described the preferred embodiments of the invention, it will be understood that the invention may be embodied otherwise than as herein specifically illustrated or described, and that in the illustrated embodiments certain changes in the details of construction and in the form and arrangement of parts may be made without departing from the underlying idea or principles of this invention within the scope of the appended claims.

Having thus described my invention, what I claim and desire to secure by Letters Patent is:

1. A genuine leather glove comprising a plurality of single layer, unsupported geometrical sections cut from genuine leather left over scrap, said sections being of selectively predetermined configurations and being secured to each other in end-to-end and side-by-side relation to form a continuous piece having ornamental characteristics imparted thereto by said secured together sections of predetermined geometrical configuration, said piece being cut into a panel comprising left and right portions in mirror symmetrical relation to each other, each of said portions including four discrete upwardly extending elongated segments, said left and right portions being stitched to each other along their outer and upper periphery to define a glove body having four finger stalls, one of said panel portions having an opening the contour of which has secured thereto a thumb stall made from said piece, whereby the entire glove has imparted thereto the ornamental characteristics of said continuous piece.

2. A method of making a genuine leather mitten from left over genuine leather scraps comprising (a) cutting from said scraps a plurality of sections having selectively predetermined geometrical configurations, (b) stitching some of said sections in end-to-end relation for forming rows of said sections, (c) stitching a plurality of said rows in side-by-side relation to form a continuous piece, (d) cutting from said piece a panel in accordance with a conventional mitten pattern, and (e) finishing said panel into a conventional mitten, whereby said mitten has the ornamental characteristics imparted thereto by said stitched together sections of predetermined geometrical configurations.

3. A genuine leather mitten comprising a plurality of single layer, unsupported geometrical sections cut from genuine leather left over scrap, said sections being of selectively predetermined configurations and being secured to each other in end-to-end and side-by-side relation to form a continuous piece having ornamental characteristics imparted thereto by said secured together sections of predetermined geometrical configuration, said piece being cut into a panel in accordance with a conventional mitten pattern and being thereafter finished into said mitten.

* * * * *

UNITED STATES PATENT AND TRADEMARK OFFICE

CERTIFICATE OF CORRECTION

PATENT NO. : 4,100,623

DATED : July 18, 1978

INVENTOR(S) : Murray Strongwater

It is certified that error appears in the above-identified patent and that said Letters Patent are hereby corrected as shown below:

On the cover sheet below the Abstract, delete "3 Claims" and substitute --- 2 Claims ---.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,100,623

DATED : July 18, 1978

INVENTOR(S) : Murray Strongwater

It is certified that error appears in the above-identified patent and that said Letters Patent are hereby corrected as shown below:

Delete Claim 2.

On the cover sheet below the Abstract, delete "3 Claims" and substitute -- 2 Claims --.

This certificate supersedes Certificate of Correction issued January 16, 1979.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*